US008312563B1

(12) United States Patent
Burns

(10) Patent No.: US 8,312,563 B1
(45) Date of Patent: Nov. 20, 2012

(54) PROTECTIVE GLOVE WITH THUMB AND WRIST SUPPORT

(76) Inventor: Walter Burns, Lake Forest, IL (US)

( * ) Notice: Subject to any disclaimer, the term of this patent is extended or adjusted under 35 U.S.C. 154(b) by 307 days.

(21) Appl. No.: 12/756,076

(22) Filed: Apr. 7, 2010

(51) Int. Cl.
*A41D 13/08* (2006.01)

(52) U.S. Cl. ..... 2/16; 2/161.1

(58) Field of Classification Search ..... 2/16, 161.1, 2/19, 20, 162, 163; 602/20–22, 62, 64
See application file for complete search history.

(56) References Cited

U.S. PATENT DOCUMENTS

| | | | | | |
|---|---|---|---|---|---|
| 4,438,532 | A | | 3/1984 | Campanella | |
| 4,561,122 | A | | 12/1985 | Stanley et al. | |
| 4,742,579 | A | | 5/1988 | Dunford | |
| 4,941,460 | A | * | 7/1990 | Working | 602/21 |
| 4,984,301 | A | | 1/1991 | Jordan | |
| 5,058,576 | A | * | 10/1991 | Grim et al. | 602/21 |
| 5,203,766 | A | * | 4/1993 | Carter et al. | 602/21 |
| 5,237,703 | A | | 8/1993 | Brine | |
| 5,279,545 | A | * | 1/1994 | Reese, Sr. | 602/21 |
| 5,313,667 | A | * | 5/1994 | Levine | 2/16 |
| 5,526,531 | A | | 6/1996 | Olson | |
| 5,561,856 | A | | 10/1996 | Pesco | |
| 5,600,849 | A | | 2/1997 | Hu | |
| 5,682,611 | A | | 11/1997 | Kline | |
| 5,848,440 | A | | 12/1998 | Pajarola | |
| 5,873,130 | A | | 2/1999 | Lafferty | |
| 5,884,329 | A | * | 3/1999 | Goldsmith et al. | 2/16 |
| 5,898,936 | A | | 5/1999 | Janes | |
| 5,933,868 | A | | 8/1999 | Bender | |
| 5,953,752 | A | | 9/1999 | Jones | |
| 5,963,985 | A | | 10/1999 | Behr et al. | |
| 5,987,641 | A | * | 11/1999 | Walker | 2/16 |
| 5,988,681 | A | | 11/1999 | Vesalainen | |
| 6,141,801 | A | | 11/2000 | Helenick | |
| 6,279,159 | B1 | | 8/2001 | Ahlbaumer et al. | |
| 6,328,706 | B1 | * | 12/2001 | Yattavong | 602/21 |
| 6,341,376 | B1 | | 1/2002 | Smerdon, Jr. | |
| 6,496,984 | B1 | * | 12/2002 | Chow | 2/16 |
| 6,732,376 | B2 | | 5/2004 | Hoffman | |
| 7,200,872 | B2 | | 4/2007 | Gregory | |
| 7,475,433 | B2 | | 1/2009 | Coulter et al. | |
| 2003/0066119 | A1 | | 4/2003 | Mazzarolo | |
| 2006/0212989 | A1 | | 9/2006 | White | |
| 2007/0157364 | A1 | | 7/2007 | Comstock | |
| 2007/0226872 | A1 | | 10/2007 | Huh | |
| 2008/0109944 | A1 | | 5/2008 | Beebe | |
| 2009/0077706 | A1 | | 3/2009 | Prather | |

* cited by examiner

*Primary Examiner* — Danny Worrell
(74) *Attorney, Agent, or Firm* — James P. Muraff; Neal, Gerber & Eisenberg LLP

(57) ABSTRACT

An apparel for protecting a hand and wrist of a user, which includes a hand cover and support element, is provided. The support element includes a first portion that receives a metacarpal area of the user's hand, a second portion that receives the thumb of the user, and a binding portion for reinforcing a thumb web connection between the first portion and the second portion.

16 Claims, 5 Drawing Sheets

PROTECTIVE GLOVE WITH THUMB AND WRIST SUPPORT

TECHNICAL FIELD

This invention relates generally to hand covers that provide thumb and/or wrist protection. More particularly, the present invention relates to protective gloves having insertable or built-in thumb and wrist supports that protect and restrict undesirable movements of thumbs and wrists.

BACKGROUND OF THE INVENTION

This invention relates generally to thumb and wrist protection. Prior order generating protection devices have been attempted and implemented. One such device, disclosed within U.S. Pat. No. 5,526,531, to Scott B. Olson et al., issued on Jun. 18, 1996, is directed to a wrist guard which has a molded body having its first end configured to contact a user's palm and a second end configured to engage the user's forearm. A thumb receiving member is located at a first side of the palm end of the wrist guard and is designed to prevent overextension of the thumb. The forearm portion stabilizes the wrist guard so it does not rotate. The first strap extends betweens the thumb covering and the opposing side of the first end of the palm and of the stiff body member. This strap is selectively adjustable to ensure proper fit. A second strap is located at the forearm end of the wrist guard. This strap, like the first strap, is selectively adjustable to ensure proper fit. The user will insert their thumb into the thumb receiving member and tighten the straps for securing the wrist guard. U.S. Pat. No. 5,526,531 is incorporated herein by reference for at least the purpose of giving context to the present invention.

U.S. Pat. No. 7,475,433 B2 to Ryan C. Coulter et al., issued on Jan. 13, 2009, is directed to a glove which includes two "H" shaped stiffening battens on a dorsal side. The battens terminate on a proximal side of the second through fifth fingers, and are formed from a non-rigid material. A one-piece protective panel is attached to the palmar side of the glove. The protective panel covers portions of the wearing hand palm corresponding to the distal ends of the second through fifth metacarpal bones, as well as palmar side portions of the second through fifth digits corresponding to the second through fifth proximal phalanx bones. Flex notch cut-outs in the protective panel correspond to portions of the palmar region which tend to bunch during gripping of a bar or other object and help prevent discomfort during such gripping. U.S. Pat. No. 7,475,433 B2 is incorporated herein by reference for at least the purpose of giving context to the present invention.

Despite the hand protection provided by devices disclosed by the above introduced patents, there is still a need for a glove that can provide protection to the thumb and wrist of a skier or snowboarder, such as preventing the thumb from being bent in an unnatural direction or a backward exaggerated angle.

SUMMARY OF THE INVENTION

The present invention is defined by the appended claims. This description summarizes some aspects of the present embodiments and should not be used to limit the claims.

The foregoing problems are solved and a technical advance is achieved by articles of manufacture consistent with the present invention, which provide support for a thumb and wrist of a skier or a snowboarder.

One embodiment of the present invention is directed to an apparel for protecting a hand and wrist of a user, which includes a hand cover and support element, is provided. The support element includes a first portion that receives a metacarpal area of the user's hand, a second portion that receives the thumb of the user, and a binding portion for reinforcing a thumb web connection between the first portion and the second portion.

Another embodiment of the present invention is directed to an apparel for protecting a hand and wrist of a user, which comprises a hand cover and an S-shaped support element that ergonomically overlies, longitudinally and partially laterally, the thumb and wrist of a user. The S-shaped support element comprises a distal thumb protective portion, a proximal wrist protective portion, and an S-shaped portion, wherein the S-shaped portion is between and joins the distal thumb protective portion and the proximal wrist protective portion.

In one aspect of the present invention, an apparel for protecting a hand and wrist of a user, which comprises a hand cover and a hand and wrist support element, which has a C-shaped lateral cross-section and extends longitudinally from about the root region of the index finger of the hand to about the root region of the forearm of the user. The hand and wrist support element comprises a side opening for the user's thumb. The side opening is located to substantially coincide longitudinally with the S-shaped portion that supports the base joint of the user's thumb.

Other articles of manufacture, features, and advantages of the present invention will be, or will become, apparent to one having ordinary skill in the art upon examination of the following drawings and detailed description. It is intended that all such articles of manufacture, features, and advantages included within this description, be within the scope of the present invention, and be protected by the accompanying claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

Figure 1:
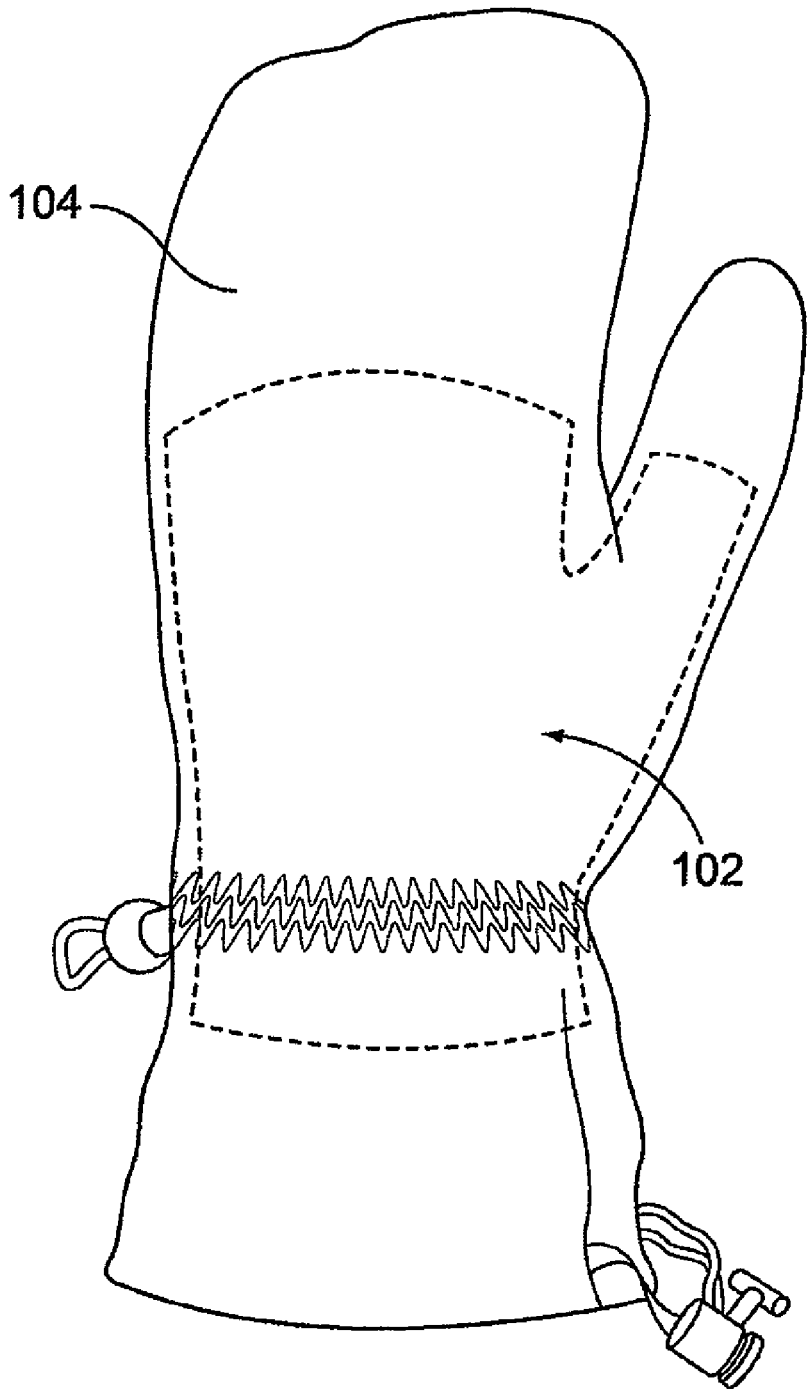
FIG. 1 is a dorsal view of an embodiment of a hand apparel having a hand cover and a hand support element in accordance with the invention.

Illustrative and exemplary embodiments of the invention are described in further detail below with reference to and in conjunction with the figures.

DETAILED DESCRIPTION OF THE DRAWINGS

The present invention is defined by the appended claims. This description summarizes some aspects of the present embodiments and should not be used to limit the claims.

While the present invention may be embodied in various forms, there is shown in the drawings and will hereinafter be described some exemplary and non-limiting embodiments, with the understanding that the present disclosure is to be considered an exemplification of the invention and is not intended to limit the invention to the specific embodiments illustrated.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects.

Referring to FIG. 1, a dorsal view of an embodiment of a protective hand apparel or hand cover 100 in which a hand support element 102 can be disposed is illustrated. A hand of a user, such as a skier or a snowboarder, can be inserted into the hand cover 100 and through the support element 102, such that a set of individual fingers of the user's hand can be further positioned into the fingered portion 104 of the hand cover 100.

Figure 2:
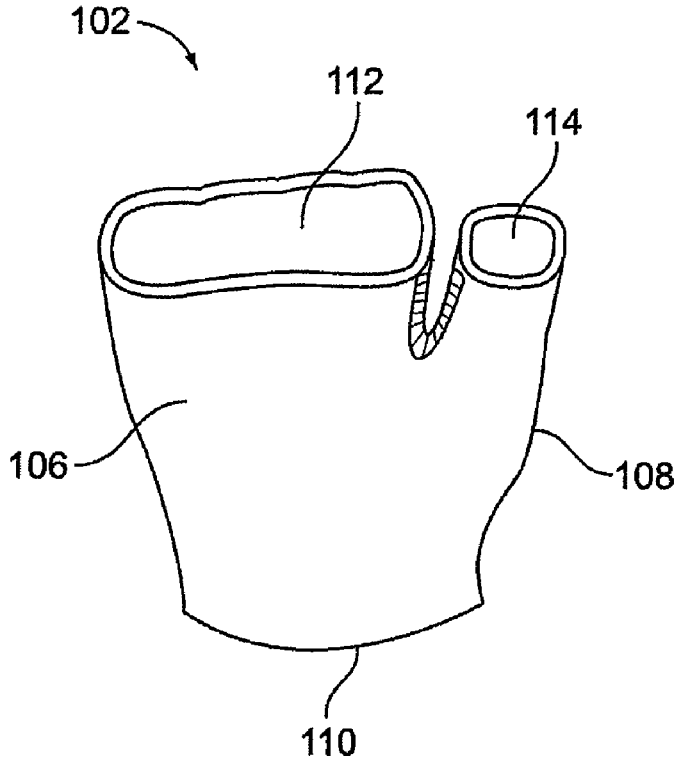
FIG. 2 is a perspective view of the support element of FIG. 1 in accordance with the invention.

The support element 102, as shown in FIG. 2, includes a metacarpal and wrist support portion 106 and a thumb support portion 108. In one embodiment, the support element 102 is configured to extend to and overlie the wrist joint or area and at least a portion of the radius bone at its bottom or proximal part and to reach the base joints of the four non-thumb fingers at its top or distal part. The metacarpal and wrist support portion 106, which substantially encircles the metacarpal bones of the four fingers of the user's hand, includes an entry opening 110 at the bottom of the support element 102, and a grouped finger opening 112 and a thumb opening 114 at the top of the support element 102. The entry opening 110 is configured to allow the user to insert his/her hand, fingers and thumb through it. The thumb portion 108 is configured to substantially receive and encapsulate the proximal phalanx of the thumb and the thumb's metacarpal bone. Because the support element 102 can be utilized by user's hand of varying size, it is understood that the support element 102 can be made in a general overall size that best suits the sizes of the varying user's hands. As an example, the support element 102 could be made in varying sizes such as small, medium, large, or extra large.

Figure 3:
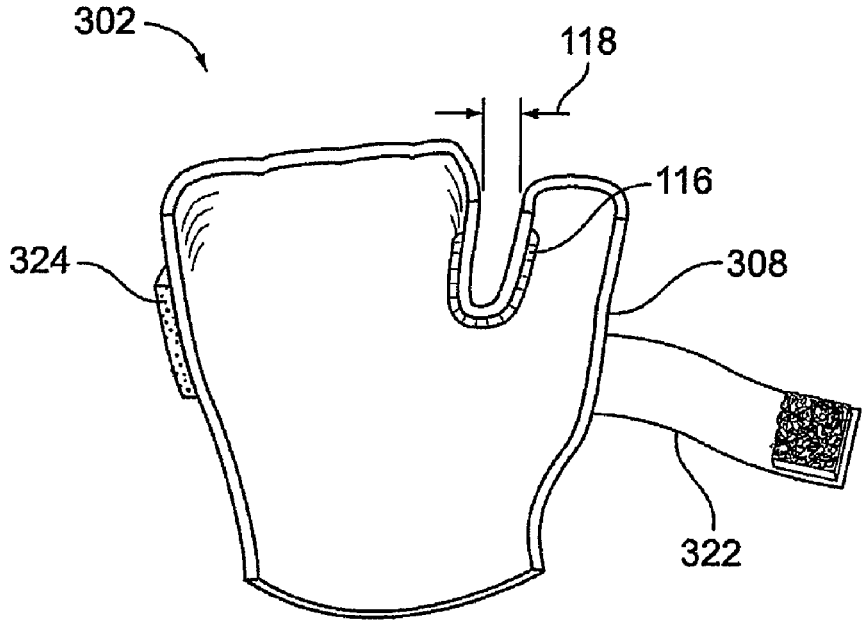
FIG. 3 is a cross-sectional view of another embodiment of the support element of FIG. 2 in accordance with the invention.

As illustrated in FIGS. 2 and 3, in the thumb web area of the support element 102 between the grouped finger opening 112 and the thumb opening 114, which covers the thumb joint gap between the thumb and the first or index finger, the support element 102 includes a reinforced binding 116 configured to add strength to the web area thereby preventing the thumb from being bent in an unnatural direction or a backward exaggerated angle, or even being dislocated in the impact of a fall from the thumb's base joint to the user's hand. Moreover, the reinforced binding 116 is configured to substantially reduce the disruption of the collateral ligament of the user's thumb's metacarpophalangeal joint to thereby substantially reduce the likelihood of radial luxation or radial subluxation of the user's thumb. The reinforced binding 116, which can add substantial strength to web area of the support element 102, can be formed as an integral part of the support element 102 or be securely bonded or affixed to the support element 102, via a strong adhesive or other fastening materials.

As seen from either a dorsal or a palmar view of the support element 102, the reinforced binding 116 can be a thickened wedge having a V-shape configuration. Once in the thumb portion 108, the user's thumb is maintained in a position such that the internal angle 118 of the reinforced binding 116 is preferably a small angle. Although, the metacarpal and wrist portion 106 and the thumb portion 108 are configured to maintain the user's thumb in a small angular position relative to the other user's fingers, it is understood that in alternative embodiments of the present invention, the bones of the user's thumb can also be positioned in other ways. For example, in one embodiment the thumb portion 108 may also hold the bones of the thumb in a manner that results in the user's thumb being in a generally straight position. In another embodiment, the thumb portion 108 may hold the bones of the user's thumb in a manner which results in the thumb bones being in an angular position with respect to one another. Moreover, the thumb portion 108 may brace the user's thumb in a position that substantially maintains the user's thumb in an orientation in which the axis resulting from the alignment of the bones in the user's thumb is generally coplanar with the bones of the palm area of the user's hand.

As illustrated in FIG. 1, the support element 102 is disposed within the hand cover 100. The support element 102 can be a stand-alone element or a built-in element of the hand cover 100. One advantage of the stand-alone support element 102 is that it would be transferrable from one hand cover 100 to another. In some embodiments, the support element 102 may be located within the hand cover 100 such that the support element 102 is in direct contact with the user's hand while the hand cover 100 is in a position away from the hand at the location of the support element 102. This is to say that the support element 102 can be positioned between the user's hand and the hand cover 100. In another embodiment of the present invention, the support element 102 can be disposed between various layers of the hand cover 100. In that embodiment, the support element 102 would not be in direct contact with the user's hand, but may instead be located between two layers of the hand cover 100. That is, the support element 102 can be substantially disposed in the hand cover 100 between an inside lining layer (not shown) and an outside lining layer (not shown). The support element 102 may further be configured with holes (not shown) around the periphery of the openings 110 and 112 so it could be sewn to one of the lining layers of the hand cover 100. In yet another embodiment, the support element 102 can be located on the outside of the hand cover 100. The hand cover 100 can be a fingered glove, a fingerless glove or a mitten.

The support element 102 can be made from any suitably strong material that provides the desirable strength to the support element 102 in general, and to the thumb portion 108, in particular. The material of the support element 102 can be, for example, a Kevlar "bullet proof" type material, a hard plastic material, and may include steel as a reinforcement material of the reinforced binding 116. It should be understood that the materials used for the support element 102 and the reinforced binding 116 can vary widely within the practice of this invention.

Referring back to FIG. 3, the support element 302, 102 may include a thumb wrap element 320, to further support the thumb portion 308, 108. The thumb wrap element 320 includes a strap element 322 secured at the palmar side of the support element 302, 102 next to the base of the thumb portion 308, 108 of the support element 302, 102, and preferably close to the root region of the index finger. The thumb wrap element 320 can be removably and securely fastened to a fastening connection or element 324 formed on the dorsal side of the support element 302, 102. Alternately, the strap element 322 may be irremovably secured at the dorsal side of the support element 302, 102 next to the base of the thumb portion 308, 108 of the support element 302, 102, and preferably close to the dorsal root region of the index finger, and which can be removably and securely affixed to a fastening connection 324 formed on the palmar side of the support element 102. Once the strap element 322 is fastened to the fastening connection 324, a strapping loop (not shown) is formed around the thumb portion 308, 108. The strap element 322 can be formed as a non-elastic strap or a just slightly stretchable elastic strap. The wrap element 320 can be a Velcro closer wrap or other suitable fastening wraps.

Figure 4:
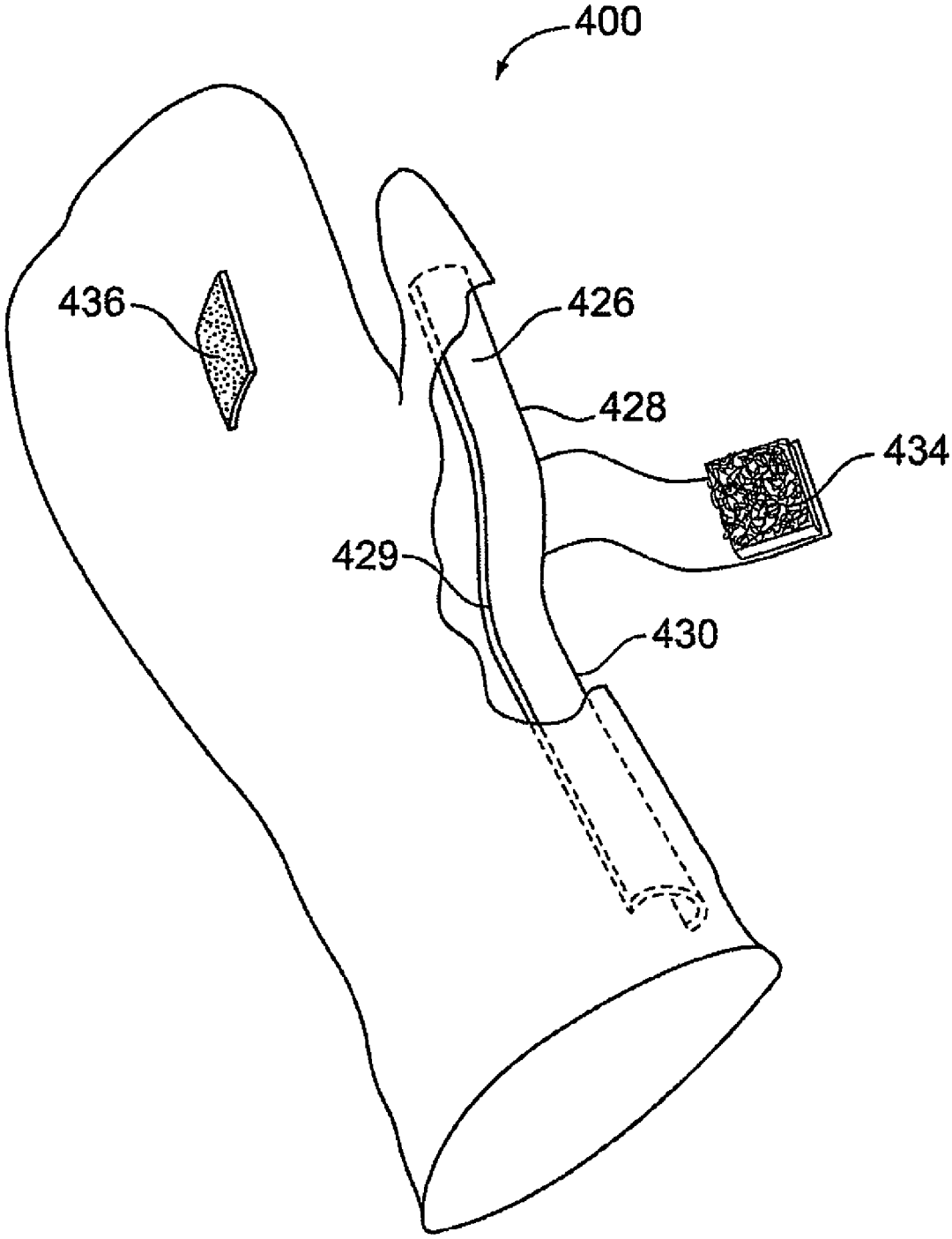
FIG. 4 is dorsal view of an embodiment of an "S" curved splint built to a hand cover in accordance with the invention.

Now referring to FIG. 4, an embodiment of an "S" curved splint 426 that can be built into the hand cover 400, 100 is shown. The "S" curved splint 426, which is configured as a thumb and wrist protector, is ergonomically shaped to contour longitudinally the thumb and wrist longitudinal side areas of the user, and to contour laterally the thumb and wrist lateral side areas of the user. The "S" curved splint 426 includes a distal thumb protective portion 428, a proximal wrist protective portion 430, which are joined by an "S" curved portion 429. The thumb protective portion 428 overlies the thumb proximal phalanx, the thumb metacarpal bone and preferably the joint connecting the proximal phalanx to the distal phalanx of the thumb. The "S" curved portion 429 is configured to ergonomically overlie the curved connections of the thumb to the hand and of the hand to the wrist of the user. The proximal wrist protective portion 430 is long enough to overlie the radius side of the wrist area and at least a proximal portion of the forearm radius of the user. As configured, the splint 426 can protect the user by minimizing the impact of external blows, and by preventing or at least minimizing injuries resulting from hyper-extension of the thumb toward the wrist area and of the wrist towards the forearm area. The "S" curved splint 426 can help transfer the force of external blows away from the vulnerable metacarpalphalangeal joint of the thumb to the sturdier joints of the wrist area (e.g. the carpometacarpal joint). In another embodiment, the hand cover 400, 100, into which the splint 426 is built, can be further equipped with a thumb wrap element 432. The thumb wrap element 432 can also include a strap element 434 secured at the palmar side of the hand cover 400, 100 next to the base of the thumb protective portion 428, and preferably close to the root region of the index finger, and which can be removably fastened to a fastening connection 436 formed on the dorsal side of the hand cover 400, 100. Once the strap element 434 is fastened to the fastening connection 436, a strapping loop (not shown) is formed around the splint 426. The strap element 434 can also be formed as a non-elastic strap or a just slightly stretchable elastic strap. Alternately, the strap element 434 can be formed of the same material as that of the hand cover 400, 100. The wrap element 432 can also be a Velcro closer wrap or other suitable fastening wraps. The strapping loop, when formed, can be slightly larger than the thumb piece of the hand cover 400, 100 which receives the splint 426, when in use, so that there is some play or freedom of movement of the user's thumb. The formed strapping loop can be effective in preventing abduction of the user's thumb, which may occur for example in a spill during skiing or snowboarding.

Figure 5:
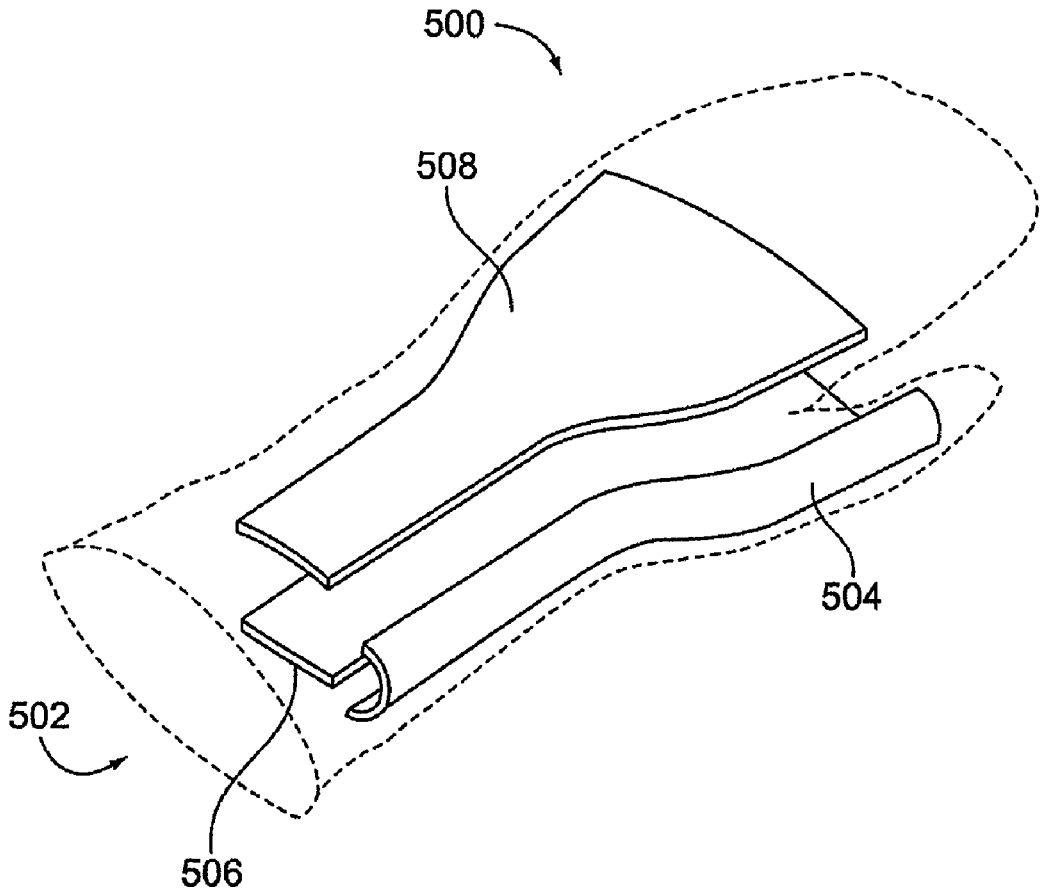
FIG. 5 is a dorsal view of an embodiment of a protective support including the "S" curved splint of FIG. 4 in accordance with the invention.

Now referring to FIG. 5, a dorsal view of an embodiment of a protective support assembly 502 including the "S" curved splint 504, 426 of FIG. 4 is shown. The protective support assembly 502, which can be built in the hand cover 500, 400, 100, includes a pair, dorsal and palmar, of hand and wrist supports 506 and 508. The dorsal hand and wrist support 506 is configured to contour ergonomically the dorsal side of the hand and wrist of the user, preferably from the dorsal root region of the four fingers of the hand to the root region of the forearm of the user. In a similar fashion, the palmar hand and wrist support 508 is configured to contour ergonomically the palmar side of the hand and wrist of the user, preferably from the palmar root region of the four fingers of the hand to the root region of the forearm of the user. The "S" curved splint 504 and the hand and wrist supports 506 and 508 can be affixed to one another to form a continuous protective support assembly 502. Alternately, the three protective elements 504, 506 and 508, may be independently built into the hand cover 100.

Figure 6:
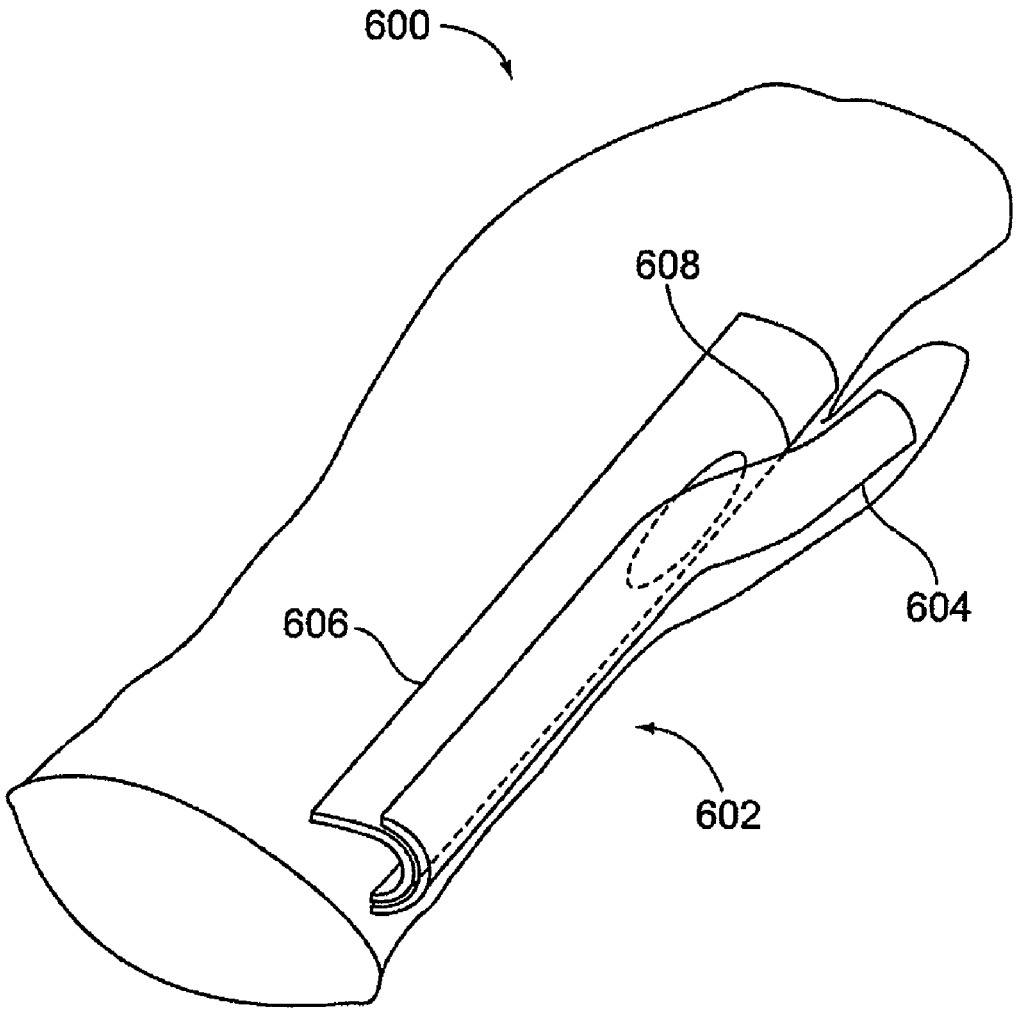
FIG. 6 is a dorsal view of another embodiment of a protective support including the "S" curved splint of FIG. 4 in accordance with the invention.

Now referring to FIG. 6, a dorsal view of another embodiment of a protective support assembly 602 including the "S" curved splint 604, 504, 402 of FIG. 4 is shown. The protective support assembly 602, which can be built in the hand cover 600, 500, 400, 100, also includes an elongated hand and wrist support 606, which has a general arcuate C-shaped lateral cross-section. The hand and wrist support 606 includes a side opening (not shown) through which a user's thumb can protrude, when in use. The side opening is located to substantially coincide longitudinally with the portion of the "S" curved splint 604 that supports the base joint of the user's thumb. The elongated hand and wrist support 606 can extend longitudinally preferably from the root region of the index finger of the hand to the root region of the forearm of the user. The "S" curved splint 604 and the hand and wrist support 606 are securely affixed to one another to prevent any longitudinal sliding of one with respect to the other. Alternately, the protective support assembly 600 may be formed as a one-piece protective element. In one embodiment, the connection between the "S" curved splint 604 and the hand and wrist support 606, in the vicinity of the web area of the user's thumb, may also be reinforced by a reinforcing binding 608 to add desirable strength to the web area.

Similarly to the support element 102, the "S" curved splint 426, the protective support assembly 502, and the protective support assembly 602 can be made from any suitably strong material that provides the desirable strength and impact resistance. The suitable material can be, for example, a Kevlar "bullet proof" type material, a hard plastic material, and may include steel as a reinforcement material of the reinforced bindings 116 and 608. It should be understood that the materials used can vary widely within the practice of this invention.

It should be emphasized that the above-described embodiments of the present invention, particularly, any "preferred" embodiments, are possible examples of implementations, merely set forth for a clear understanding of the principles of the invention. Many variations and modifications may be made to the above-described embodiment(s) of the invention without substantially departing from the spirit and principles of the invention. All such modifications are intended to be included herein within the scope of this disclosure and the present invention and protected by the following claims.

The invention claimed is:

1. An apparel for protecting a hand and wrist of a user, comprising:

a hand cover;

an S-shaped support element that ergonomically overlies, longitudinally and partially laterally, the thumb and wrist of the user;

a dorsal support element, which overlies ergonomically the dorsal side of the hand and wrist of the user from approximately the dorsal root region of the four fingers of the hand to the root region of the forearm of the user; and palmar support element, which overlies ergonomically the palmar side of the hand and wrist of the user from approximately the palmar root region of the four fingers of the hand to the root region of the forearm of the user.

2. The apparel of claim 1, wherein the S-shaped support element comprises a distal thumb protective portion, a proximal wrist protective portion, and an S-shaped portion, wherein the S-shaped portion is between and joins the distal thumb protective portion and the proximal wrist protective portion.

3. The apparel of claim 2, wherein the thumb protective portion overlies ergonomically the thumb proximal phalanx, the thumb metacarpal, and the joint connecting the proximal phalanx to the distal phalanx of the thumb.

4. The apparel of claim 2, wherein the S-shaped portion overlies ergonomically the longitudinal curved connections of the thumb to the hand and of the hand to the wrist of the user.

5. The apparel of claim 2, wherein the proximal wrist protective portion is overlies longitudinally the radius side of the wrist and at least a portion of the forearm radius of the user.

6. The apparel of claim 1, further comprising a wrapping element having a strap element and a fastening element, wherein when the strap element is fastened to the fastening element a wrapping loop is formed around the S-shaped element.

7. The apparel of claim 1, wherein the S-shaped support element, the palmar support element and the dorsal support element are affixed together.

8. The apparel of claim 1, wherein the S-shaped support element, the palmar support element and the dorsal support element are independently built into the hand cover.

9. An apparel for protecting a hand and wrist of a user, comprising:

a hand cover;

an S-shaped support element that ergonomically overlies, longitudinally and partially laterally, the thumb and wrist of the user; and a hand and wrist support element, which has a C-shaped lateral cross-section and extends longitudinally from about the root region of the index finger of the hand to about the root region of the forearm of the user.

10. The apparel of claim 9, wherein the hand and wrist support element comprises a side opening for the user's thumb.

11. The apparel of claim 10, wherein the side opening is located to substantially coincide longitudinally with the S-shaped portion that supports the base joint of the user's thumb.

12. The apparel of claim 9, wherein the S-shaped support element comprises a distal thumb protective portion, a proximal wrist protective portion, and an S-shaped portion, wherein the S-shaped portion is between and joins the distal thumb protective portion and the proximal wrist protective portion.

13. The apparel of claim 12, wherein the thumb protective portion overlies ergonomically the thumb proximal phalanx, the thumb metacarpal, and the joint connecting the proximal phalanx to the distal phalanx of the thumb.

14. The apparel of claim 12, wherein the S-shaped portion overlies ergonomically the longitudinal curved connections of the thumb to the hand and of the hand to the wrist of the user.

15. The apparel of claim 12, wherein the proximal wrist protective portion is overlies longitudinally the radius side of the wrist and at least a portion of the forearm radius of the user.

16. The apparel of claim 9, further comprising a wrapping element having a strap element and a fastening element, wherein when the strap element is fastened to the fastening element a wrapping loop is formed around the S-shaped element.

* * * * *